United States Patent [19]

Shekel et al.

[11] 4,373,762

[45] Feb. 15, 1983

[54] AUXILIARY CONNECTOR INCLUDING FLIP ADAPTER

[75] Inventors: Joseph Shekel, New York; Joseph DeStefano, Carle Place, both of N.Y.

[73] Assignee: Auto-Line Manufacturing Corp., Copaigue, N.Y.

[21] Appl. No.: 207,913

[22] Filed: Nov. 18, 1980

[51] Int. Cl.[3] ..... H01R 11/24; H01R 27/00

[52] U.S. Cl. ..... 339/31 B; 339/29 B; 339/95 B; 339/228

[58] Field of Search ..... 339/28, 29 R, 29 B, 339/95 B, 224, 25 BR, 25 C, 228, 261, 31 R

[56] References Cited

U.S. PATENT DOCUMENTS

| | | | |
|---|---|---|---|
| 1,492,657 | 5/1924 | Walker | 339/261 |
| 1,821,443 | 9/1931 | Mohr | 339/258 C |
| 3,745,516 | 7/1973 | Lieberman | 339/258 R X |
| 4,006,952 | 2/1977 | Puckett | 339/29 B X |
| 4,082,401 | 4/1978 | Kruszecki | 339/224 X |

*Primary Examiner*—Eugene F. Desmond

*Attorney, Agent, or Firm*—Auslander, Thomas & Morrison

[57] ABSTRACT

A flip adapter for enabling connection of auxiliary cables to a side terminal of a side terminal battery includes a clamp adapted for fitting over and gripping the side terminal. The adapter is stored against the outside of one of the jaws of the connector of the auxiliary cables and is hinged to the connector for flipping one end of the adapter between the opposed jaws of the auxiliary connector to rotate the adapter forward into its operative position and to firmly retain it in that position.

3 Claims, 5 Drawing Figures

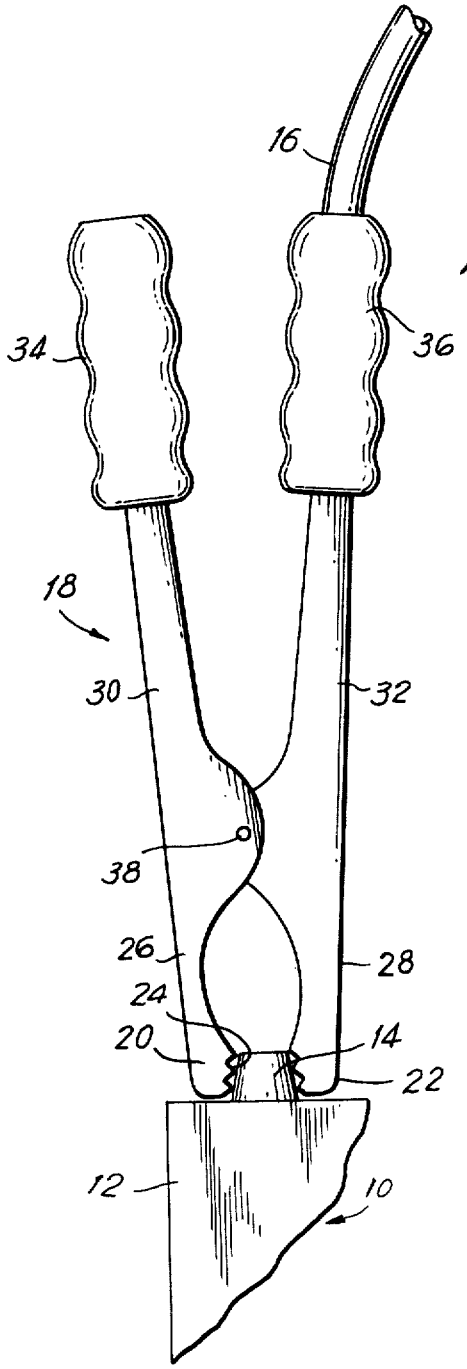
FIG. 1
PRIOR ART
FIG. 2
PRIOR ART
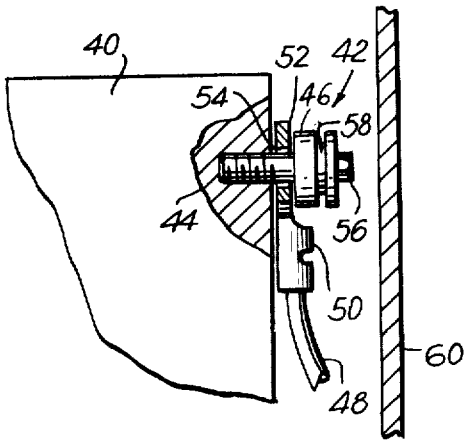

AUXILIARY CONNECTOR INCLUDING FLIP ADAPTER

CROSS REFERENCE TO RELATED APPLICATIONS

The present application is related to U.S. patent application Ser. No. 06/153,156.

BACKGROUND OF THE INVENTION

The present invention relates to auxiliary connectors for connecting auxiliary cables to battery terminals and more particularly to adapters for permitting connection of auxiliary connectors to side-terminal batteries.

In the past, conventional batteries such as, for example, lead-acid batteries for use in motor vehicles, included terminal posts projecting upward from the top of the battery. Such terminal posts were convenient for clamping or otherwise attaching booster or charging auxiliary cables employing clamp type auxiliary connectors having a pair of opposed resiliently urged jaws such as shown in U.S. Pat. Nos. 4,145,648 and 4,163,134.

More recently, side-terminal batteries have become available in which, instead of having terminal posts projecting upward where they can be reached for connection of auxiliary connectors, such batteries have terminal bolts screwed into threaded positive and negative terminal receptacles on the side walls of the battery. The receptacles project, at the most, only slightly beyond the side wall of the battery, thus making it difficult or impossible to engage side battery terminals with traditional gripping jaws of auxiliary connectors. This difficulty is further compounded by the fact that most vehicle batteries are retained in a metallic battery container having close clearance to the side of the battery and making it difficult or impossible to obtain access for the attachment of the clamping jaws of an auxiliary connector.

In order to attempt to overcome this difficulty, an auxiliary clamp for side-battery terminals has been disclosed in U.S. Pat. No. 3,745,516 which has one end adapted to engage a side-battery terminal and a second end projecting above the battery upon which conventional gripping jaws of an auxiliary connector may be clamped. Such an adapter is a small free item which is easily misplaced under conditions normal for storage of auxiliary battery cables when not in use.

A further solution is proposed in U.S. patent application Ser. No. 06/153,156 in which a side terminal adapter is pivoted to rotate in a plane parallel to the jaws of a clamp-type auxiliary connector.

OBJECTS AND SUMMARY OF THE INVENTION

It is an object of the present invention to provide an adapter for an auxiliary connector for permitting connection of the auxiliary connector to side-terminal batteries.

It is a further object of the invention to provide an adapter for an auxiliary connector which is rotatable from an inoperative position against the outside of one of the jaws of the connector into an operative position wherein a portion of it is grasped between the jaws of the auxiliary connector and a slotted portion extends forward of the jaws to engage a side terminal of a side terminal battery for permitting connection of the auxiliary connector to the side terminal battery.

According to an aspect of the present invention, there is provided an auxiliary connector for connection to a top terminal battery and a side terminal battery comprising first and second opposed jaws, means for resiliently urging the first and second opposed jaws toward each other whereby they are effective for grasping a top terminal of a top terminal battery, an adapter hinged to the first jaw and having first and second positions, the first position being an inoperative position wherein the adapter is disposed against an outer surface of the first jaws, the second position being an operative position wherein a portion of the adapter is grasped between the first and second jaws, and the adapter, when in the second position, having means projecting from between the jaws and effective to engage a side terminal of a side terminal battery.

According to a feature of the invention, there is provided an adapter for permitting connection of an auxiliary connector having first and second jaws to a side terminal of a side terminal battery comprising a metallic member having a generally flat portion, means for hinging the metallic member to the first jaw, the means for hinging being effective to permit first and second positions of the flat portion, the first position placing the flat portion adjacent an outside surface of the first jaw, the second position placing the flat portion between the first and second jaws and whereby the flat portion is rigidly clamped therebetween, the flat portion extending forward a substantial distance beyond the first and second jaws when the adapter is in its second position, and means on the part of the flat portion extending forward for fitting over and making mechanical and electrical connection to the side terminal.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a side elevation showing a portion of a top terminal battery to which is attached an auxiliary connector of an auxiliary cable;

FIG. 2 is a side elevation of a side terminal battery showing details of the side terminal with a battery cable attached thereto;

DETAILED DESCRIPTION OF THE PREFERRED EMBODIMENTS

Figure 3:
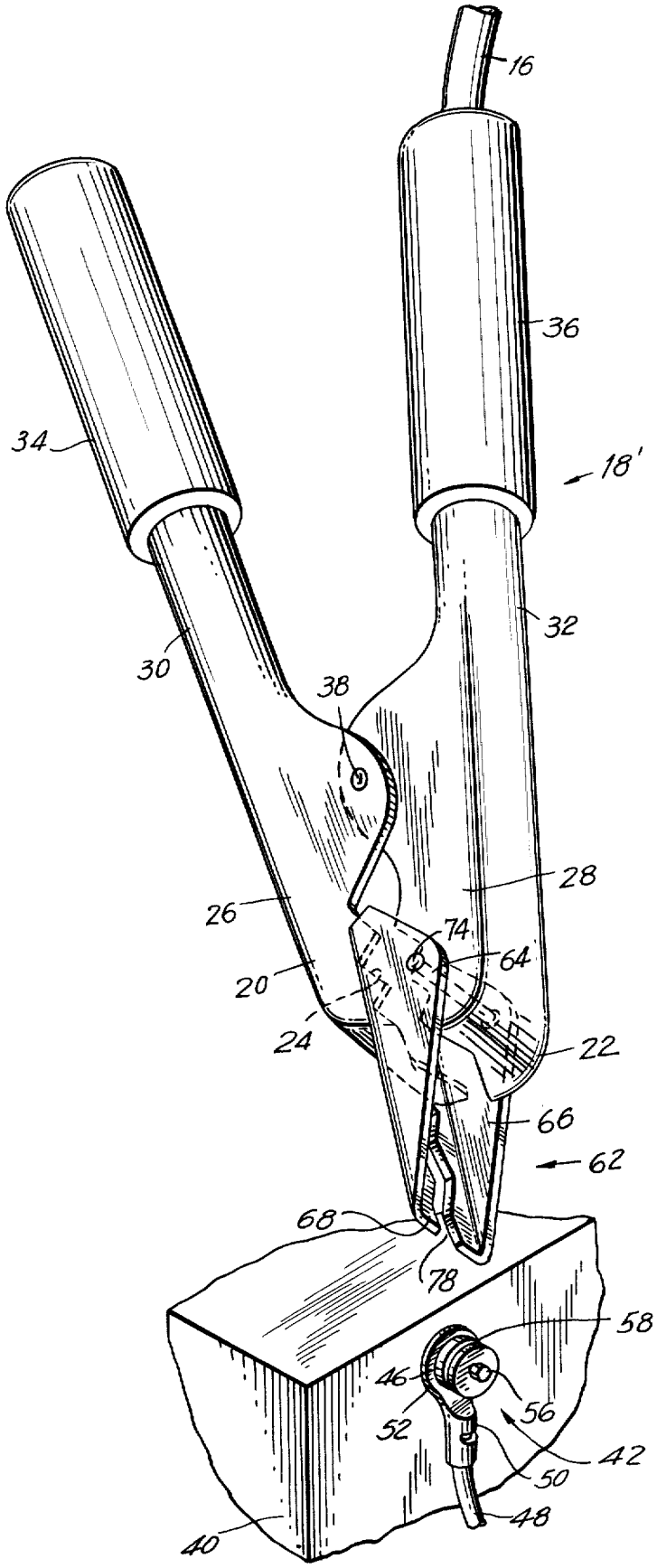
FIG. 3 is a perspective view of a side terminal battery and an auxiliary connector including an adapter according to the present invention in position to be clamped over the side terminal.

Before beginning a description of the present invention, a brief discussion of conventional auxiliary battery cable connectors usable with conventional top terminal batteries will be given with reference to FIG. 1.

A conventional top terminal battery 10 includes a case 12, usually of insulating material. A positive or negative battery terminal 14 protrudes upward from the top of top terminal battery 10 to provide a means for connecting a conventional clamp-type battery cable connector (not shown). When it is desired to provide auxiliary power to, or receive auxiliary power from top terminal battery 10, an auxiliary cable 16 may be electrically and mechanically connected to battery terminal 14 using an auxiliary connector 18.

Auxiliary connector 18 includes a pair of opposed jaws 20 and 22 which may optionally have serrated, tooth-like facing surfaces 24 attached to lower legs 26 and 28. Upper legs 30 and 32, preferably integral with lower legs 26 and 28, respectively, form pliers-like handles for manipulating auxiliary connector 18 in attaching it to battery terminal 14. Insulating hand grips 34 and 36 may optionally be provided on upper legs 30 and 32. The assembly consisting of lower leg 26 and upper leg 30 is pivoted to the assembly consisting of lower leg 28 and upper leg 32 at a pivot 38. A resilient device, conveniently a spring (not shown) is provided for urging jaws 20 and 22 toward each other and upper legs 30 and 32 away from each other so that serrated surfaces 24 may form mechanical and electrical contact with battery terminal 14.

A side-terminal battery, such as battery 40 shown in FIG. 2, presents difficulties in using the auxiliary connector 18 of FIG. 1. Instead of having a top battery terminal, such as 14 in FIG. 1, side terminal battery 40 has a side terminal 42 extending from the side of battery 40.

Side terminal 42 includes a bolt portion 44 and a head portion 46. A positive or negative battery cable 48 includes an end terminal 50 having a washer-like connector 52 with a through-hole 54 therethrough.

End terminal 50 is firmly connected to battery 40 when bolt portion 44 of side terminal 42 is passed through through-hole 54 and head portion 46 is tightened against it, thus making firm electrical and mechanical contact between end terminal 50 and battery 40. An outer portion 56 of side terminal 42 may be provided with hexagonal or other flat surfaces to enable attachment of a wrench (not shown) for tightening side terminal 42 into battery 40. A circumferential groove 58 may be included in head portion 46.

Side-terminal battery 40 may be installed in a battery case having a metallic wall 60 closely adjacent side terminal 42. Alternatively, metallic wall 60 may comprise a portion of the engine compartment or other metallic structure of the vehicle. As shown in FIG. 2, the clearance between side terminal 42 and metallic wall 60 is insufficient to permit direct connection of jaws 20 and 22 of an auxiliary connector 18 as illustrated in FIG. 1.

In order to permit connection of auxiliary cables to side terminal 42 in the limited clearance space provided, an adapter 62, shown in FIG. 3, is included in an auxiliary connector 18'. Adapter 62 has a generally U-shape formed by first and second sides 64 and 66 at right angles to a center portion 68.

Figure 4:
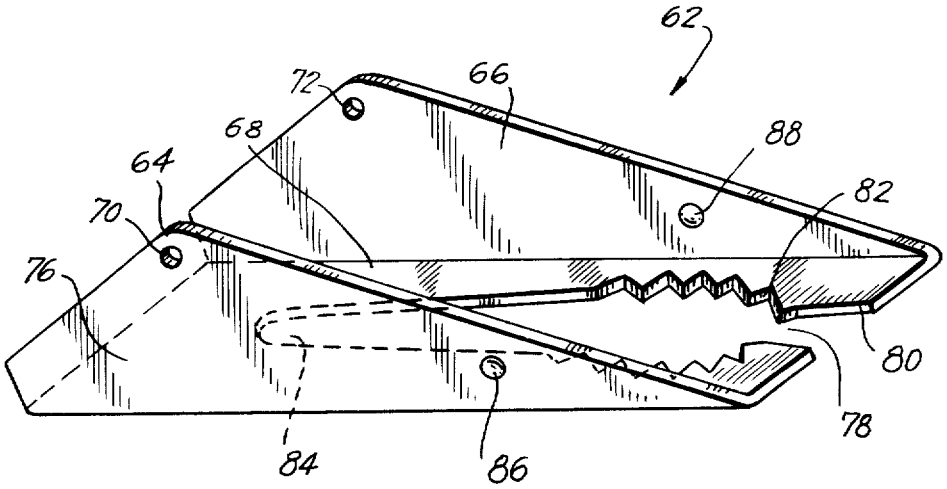
FIG. 4 is an enlarged perspective view of an adapter of FIG. 3.

Referring now also to FIG. 4, a pair of holes 70 and 72 are provided in sides 64 and 66 through which a pin 74 may pass including through matching holes (not shown) in jaw 22. Thus, adapter 62 is hingeable about pin 74.

In the position shown in FIG. 3, a rear plate 76 of center portion 68 is clamped between jaws 20 and 22 to thus maintain adapter 62 firmly in the position shown in FIG. 3 under the urging of the resilient means, such as a spring (not shown) which tend to force jaws 20 and 22 together.

Center portion 68 includes a groove 78 therein shaped to fit into and grasp circumferential groove 58 in side terminal 42 (FIGS. 2 and 3). A ramp-shaped leading portion 80 tends to spread groove 78 when pressed against side terminal 42. Teeth or serrations 82 at the edges of groove 78 thereupon grasp side terminal 42. An extension 84 of groove 78 provides additional resilience to permit spreading of groove 78 and the spring-back thereof as required to fit over and then grasp side terminal 42.

One or more dome-shaped depressions 86 may be formed in sides 64 or 66 to produce dimples 88 on the inside thereof which may be employed to retain adapter 62 in its inoperative position as will be explained.

Figure 5:
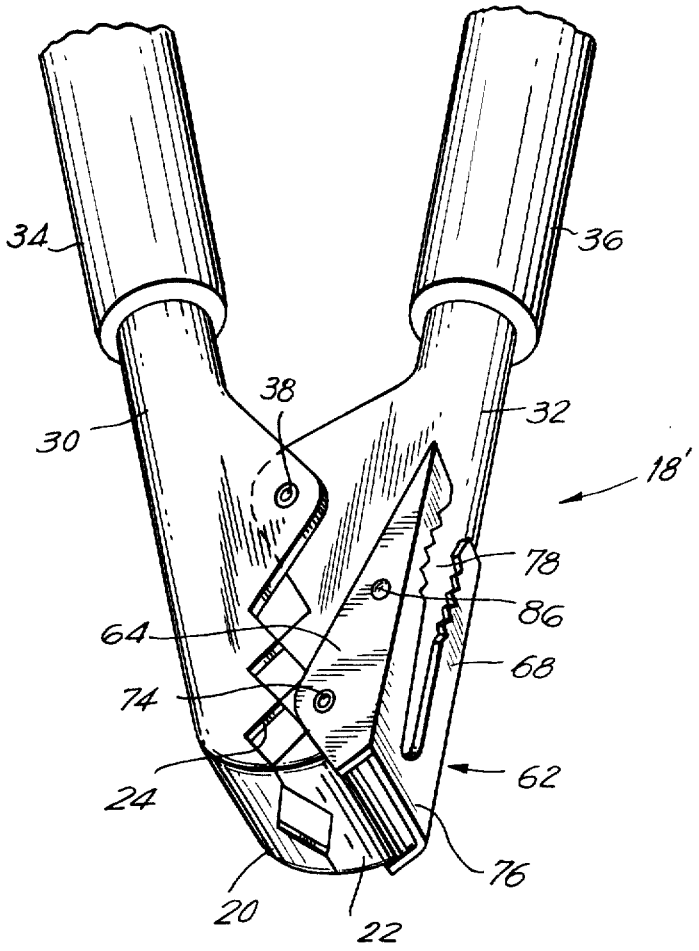
FIG. 5 is a perspective view of an auxiliary connector including an adapter according to the present invention wherein the adapter is flipped into an inoperative position.

Referring now to FIG. 5, auxiliary connector 18' is shown with adapter 62 rotated about pin 74 until center portion 68 is flat against the outer surface of jaw 22. A dimple (not shown) formed on the inside of side 64 by dome-shaped depression 86, may optionally retain adapter 62 in this position.

In order to flip adapter 62 from its operative position shown in FIG. 3 to in its inoperative position shown in FIG. 5, hand grips 34 and 36 are squeezed together against the opposing force of a spring (not shown) to thus move jaw 20 away from rear plate 76 and thus release adapter 62 so that it may be flipped into the inoperative position shown in FIG. 5.

In order to transform auxiliary connector 18' from the condition of FIG. 5 to that of FIG. 3, jaws 20 and 22 are opened by squeezing handles 34 and 36 and adapter 62 is rotated about pin 74 to place rear plate 76 between jaws 20 and 22. When jaws 20 and 22 are permitted to come together, adapter 62 is rigidly held between them. The spring loaded contact between jaws 20 and 22 and rear plate 76 ensure both rigid mechanical contact as well as low-resistance electrical contact therebetween.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An auxiliary connector for connection to a top terminal battery and a side terminal battery comprising:

first and second opposed jaws;

means for resiliently urging said first and second opposed jaws toward each other whereby they are effective for grasping a top terminal of a top terminal battery;

an adapter hinged to said first jaw and having first and second positions;

said first position being an inoperative position wherein said adapter is disposed against an outer surface of said first jaws;

said second position being an operative position wherein a portion of said adapter is grasped between said first and second jaws; and said adapter, when in said second position, having means projecting from between said jaws and effective to engage a side terminal of a side terminal battery.

2. An auxiliary connector according to claim 1 wherein said adapter includes:

a generally U-shaped metallic member having a center portion and first and second opposed sides contiguous to said center portion;

a groove in an end of said center portion, said groove being adapted for fitting over and grasping a side terminal of a side terminal battery;

first and second aligned holes in said first and second opposed sides;

third and fourth holes in said first jaw aligned with said first and second aligned holes; and a pin through said first, second, third and fourth holes and effective to permit said adapter to rotate thereupon.

3. An adapter for permitting connection of an auxiliary connector having first and second jaws to a side terminal of a side terminal battery comprising:

a metallic member having a generally flat portion;

means for hinging said metallic member to said first jaw;

said means for hinging being effective to permit first and second positions of said flat portion;

said first position placing said flat portion adjacent an outside surface of said first jaw;

said second position placing said flat portion between said first and second jaws and whereby said flat portion is rigidly clamped therebetween;

said flat portion extending forward a substantial distance beyond said first and second jaws when said adapter is in its second position; and means on the part of said flat portion extending forward for fitting over and making mechanical and electrical connection to said side terminal.

* * * * *